US006840788B2

(12) United States Patent
Ju

(10) Patent No.: US 6,840,788 B2
(45) Date of Patent: Jan. 11, 2005

(54) BGA (BALL GRID ARRAY) ELECTRICAL CONNECTOR

(75) Inventor: Ted Ju, Keelung (TW)

(73) Assignee: Chia Tse Terminal Industry Co., Ltd., Keelung (TW)

( * ) Notice: Subject to any disclaimer, the term of this patent is extended or adjusted under 35 U.S.C. 154(b) by 14 days.

(21) Appl. No.: 10/426,801

(22) Filed: May 1, 2003

(65) Prior Publication Data

US 2004/0219817 A1 Nov. 4, 2004

(51) Int. Cl.[7] ..... H01R 13/625
(52) U.S. Cl. ..... 439/342
(58) Field of Search ..... 439/342, 71, 83, 439/876, 259

(56) References Cited

U.S. PATENT DOCUMENTS 6,042,413 A * 3/2000 Hsiao et al. ..... 439/342
6,361,345 B1 * 3/2002 Tan ..... 439/342
6,419,514 B1 * 7/2002 Yu ..... 439/342

* cited by examiner

*Primary Examiner*—Gary Paumen
(74) *Attorney, Agent, or Firm*—Leong C. Lei

(57) ABSTRACT

A BGA electrical connector is disclosed. The connector is used for connecting a chip module such that the chip module is electrically conductive with circuit board, and the connector includes a base seat with terminal holding cavities, and an upper cover disposed on the top of the base seat and terminal within the terminal holding cavities. The upper cover includes a body and the lateral wall extended downward along the two lateral sides of the body, one end of each terminal extended to the upper cover to electrically contact with the chip module and the other end provided with easily fuse contact element. The connector is characterized in that the two sides wall of the upper cover, close to the center position thereof, is provided with an opening and the top end of the opening is not higher than the bottom face of the body.

2 Claims, 5 Drawing Sheets

BGA (BALL GRID ARRAY) ELECTRICAL CONNECTOR

BACKGROUND OF THE INVENTION (a) Technical Field

The present invention relates to a BGA (Ball Grid Array) electrical connector, and in particular, to a BGA connector having appropriate opening at the two sides of an upper cover such that the upper cover is provided with an appropriate strength and the under ball surface positioned at the base seat of the BGA connector is provided with a higher flatness.

(b) Description of the Prior Art

BGA connector has the advantages of small area of IC board being required and is presently developed to be connector for chip module. However, there are numerous of drawbacks when using BGA connector. As it is understood, all the terminals of the solder ball have to be connected tot he circuit board and therefore the flatness of the circuit board when the solder balls are mounted is very important. FIG. 1 shows the drawbacks occur with the conventional connector. Due to the fact that the two lateral wall 3 of the upper cover 2 form into an inverted U shaped with the body 4, the front and rear upward will not comply with the base set 5 to deform accordingly. Thus as shown in FIG. 2, when the upper cover 2 and the base seat 5 cause an error with respect to size, the front and rear end of the base seat 5 are bent upward (as shown in FIG. 3) this will affect the flatness of the solder ball and the contact of the BGA connector 1 with the circuit board 7 is bad. To solve the above drawback, BGA connector as shown in FIG. 4 is exploited. The lateral wall 9 of the base seat 8 is provided with an opening 10 so as to improve the flexibility of the upper cover to eliminate the error due to the size. However, this causes another problem, the less strong upper cover 8 will break and it causes production problem. Thus it is an object of the present invention to provide a BGA electrical connector which mitigates the above drawbacks.

SUMMARY OF THE INVENTION

Accordingly an object of the present invention is to provide a BGA electrical connector for connecting a chip module such that the chip module is electrically conductive with circuit board, the connector including a base seat with terminal holding cavities, an upper cover disposed on the top of the base seat and terminal within the terminal holding cavities, the upper cover including a body and the lateral wall extended downward along the two lateral sides of the body, one end of each terminal extended to the upper cover to electrically contact with the chip module and the other end provided with easily fuse contact element, characterized in that the two sides wall of the upper cover, close to the center position thereof is provided with an opening and the top end of the opening is not higher than the bottom face of the body.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
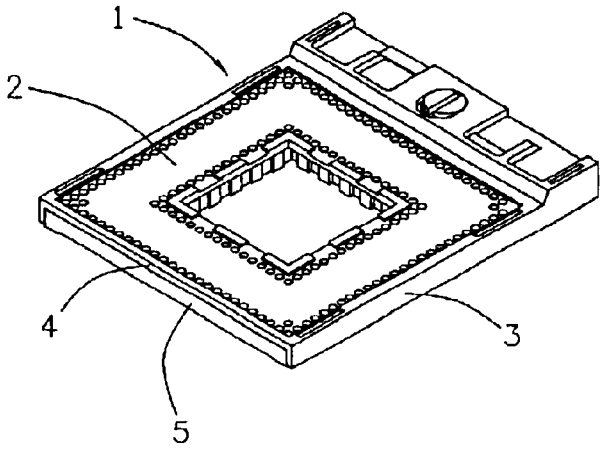
PRIOR ART FIG. 1
FIG. 1 is a perspective view of a conventional BGA electrical connector.
Figure 2:
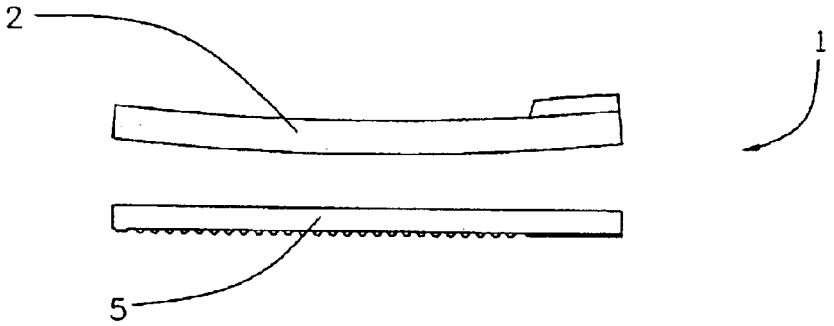
PRIOR ART FIG. 2
FIG. 2 is a side view of the upper cover prior to the mounting of the base seat, of the conventional BGA electrical connector.
Figure 3:
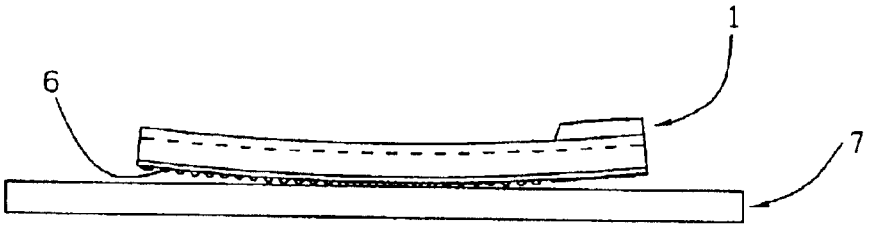
PRIOR ART FIG. 3
FIG. 3 is a side view of the upper cover prior to the mounting of the base seat, of the conventional BGA electrical connector.
Figure 4:
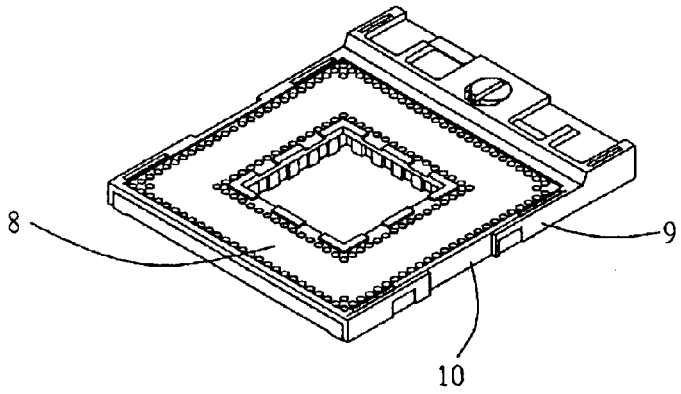
PRIOR ART FIG. 4
FIG. 4 is a perspective view of another conventional BGA connector.
Figure 5:
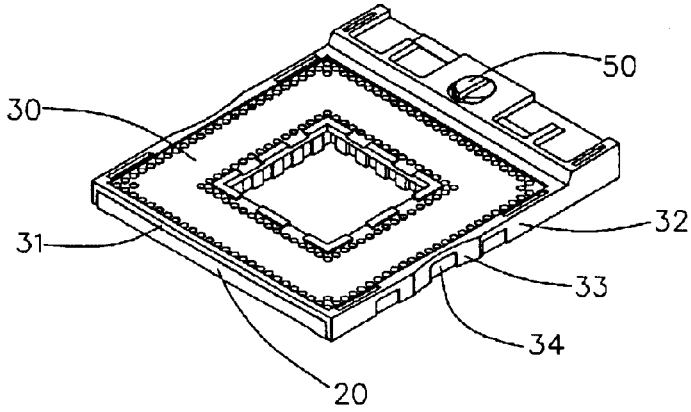
FIG. 5 is a perspective view of the BGA electrical connector of the present invention.
Figure 6:
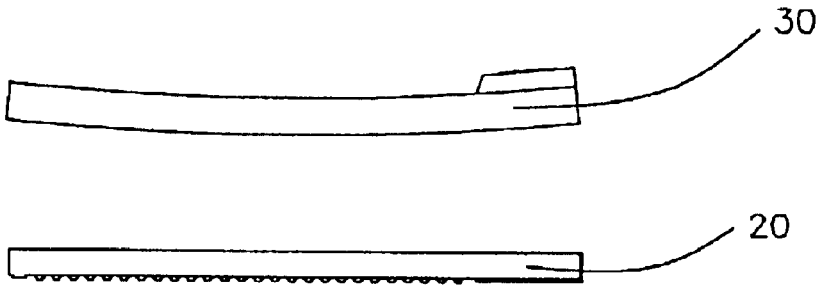
FIG. 6 is a side view of the upper cover prior to the mounting of the base seat, of the present BGA electrical connector.
Figure 7:
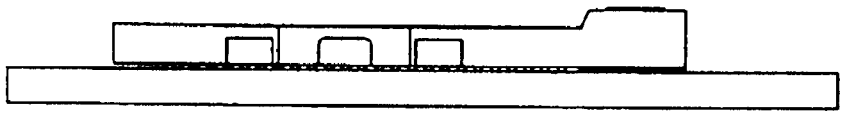
FIG. 7 a side view of the upper cover prior to the mounting of the base seat, of the present BGA electrical connector
Figure 8:
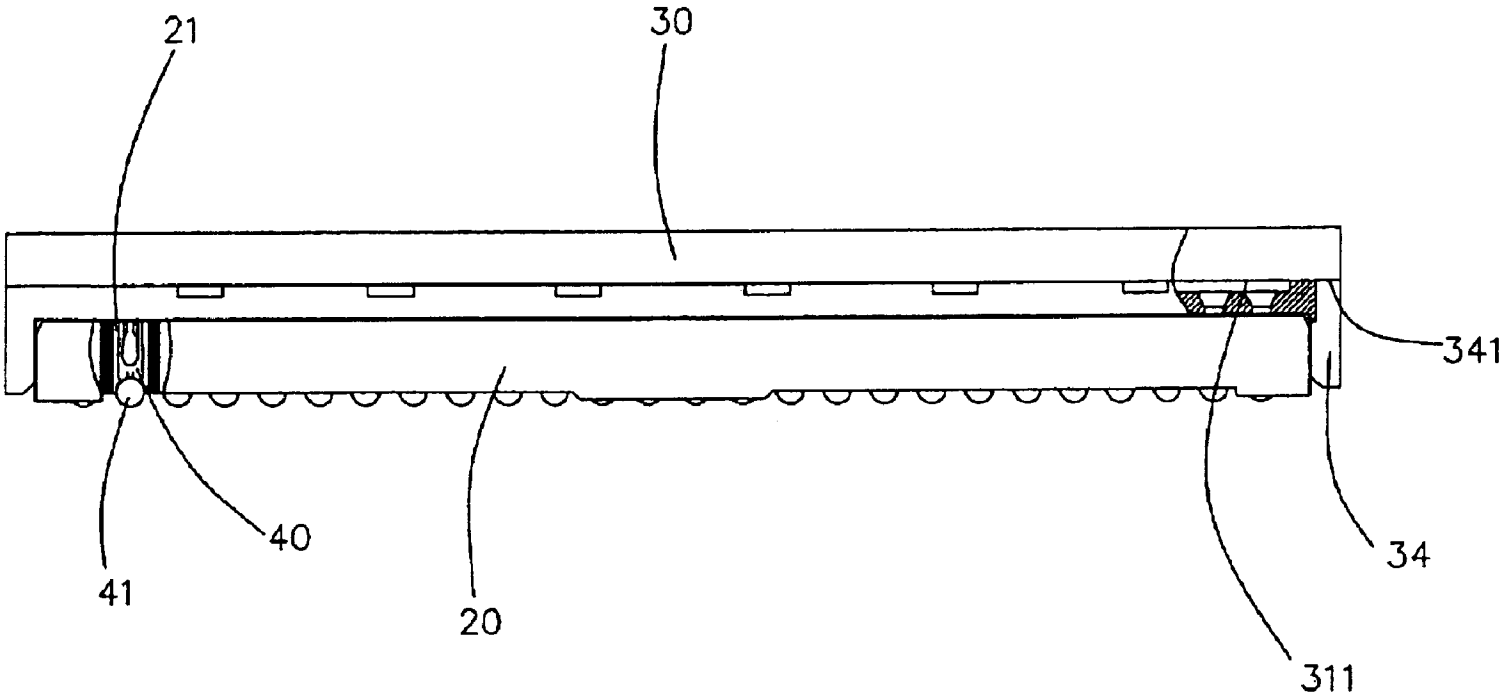
FIG. 8 is a front view of the BGA electrical connector of the present invention.

Referring to FIGS. 5, 6, 7, and 8, there is shown a BGA electrical connector for use in connecting CPU chip module (not shown) such that the chip module and the circuit board (not shown) is electrically conductive. The connector includes a base seat 20 having a plurality of terminal holding cavities 21 for terminals, an upper cover 30 disposed on the top of the base seat 20 and a terminal 40 within the terminal holding cavities 21. The base seat 20 and one end of the upper cover 30 are disposed with a driving element 50 such that the two components move relatively. One end of the terminal 40 extends upward to contact with the chip module and the other end is provided with solder ball 41. The upper cover includes a body 31 and lateral wall 32 extended downward along the two sides of the body. At a position close to the center of the wall 32, a recessed arc portion 33 is provided and the center position of the arch portion 33 is provided with a downward opening 34, such that the front and the rear of the upper cover 30 are provided with flexibility. Thus, as shown in FIG. 6, if the sizes of the upper cover 30 and the base seat 20 have a certain error, and during installation, an appropriate deformation will form so as to comply with the size of the base seat 20 (as shown in FIG. 7) this will assure that the under ball layer at the bottom of the base seat 20 is provided with a specific flatness, poor connection of the BGA electrical connector and the circuit board will not occur. As shown in FIG. 8, the top end 341 of the opening 34 and the bottom face 311 of the body 31 are aligned and thus the upper cover 30 is provided with a specific strength and will not break in the course of shipping.

In addition, the arch portion 33 facilitates the unplug of the CPU chip module from the BGA electrical connector.

Figure 9:
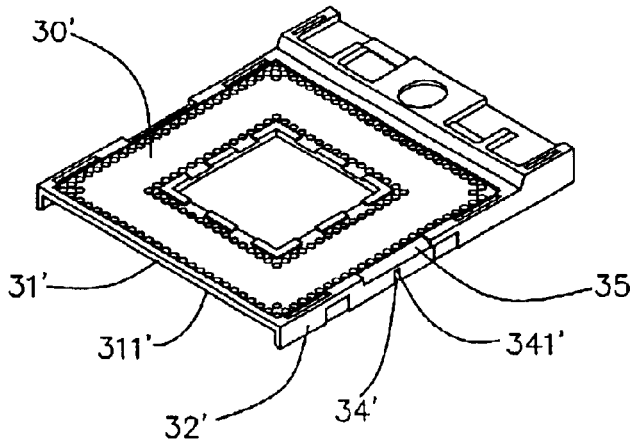
FIG. 9 is a perspective view of the upper cover of the BGA electrical connector of another preferred embodiment of the present invention.

Another configuration of the connector is shown in FIG. 9, the upper cover 30' of the connector includes the body 31' and the lateral wall 32' extended along the two sides of the body 31'. The lateral wall 32' is provided with a downward opening 34', and the upper end 341' of the opening 34' is lower than the bottom face 311' of the body 31'. The body 31' is provided with a slanting portion 35 so as to achieve the similar function of the BGA electrical connector of the previous preferred embodiment.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A BGA electrical connector for connecting a chip module such that the chip module is electrically connected to a circuit board, the connector including a base seat with terminal holding cavities, an upper cover disposed on the top of the base seat and terminal within the terminal holding cavities, the upper cover including a body and the lateral wall extended downward along the two lateral sides of body, one end of each terminal extended to the upper cover to electrically connect to the chip module and the other end provided with an easily fusible contact element, characterized in that the two lateral wall of the upper cover, close to the center thereof, are provided with an opening and the top end of the opening is not higher than the bottom face of the body, the two lateral walls of the upper cover each being provided with a recessed arch portion at the opening.

2. The electrical connector of claim 1, characterized in that the easily fuseable contact element is a solder ball.

* * * * *